US009472889B2

(12) United States Patent
Uchida

(10) Patent No.: US 9,472,889 B2
(45) Date of Patent: Oct. 18, 2016

(54) WATERPROOF CONNECTOR WITH SLEEVE

(71) Applicant: Sumitomo Wiring Systems, Ltd., Yokkaichi, Mie (JP)

(72) Inventor: Masashi Uchida, Mie (JP)

(73) Assignee: SUMITOMO WIRING SYSTEMS, LTD., Yokkaichi (JP)

( * ) Notice: Subject to any disclaimer, the term of this patent is extended or adjusted under 35 U.S.C. 154(b) by 0 days.

(21) Appl. No.: 14/733,987

(22) Filed: Jun. 9, 2015

(65) Prior Publication Data

US 2015/0380863 A1 Dec. 31, 2015

(30) Foreign Application Priority Data

Jun. 27, 2014 (JP) ..... 2014-132433

(51) Int. Cl.

| | |
|---|---|
| ***H01R 13/40*** | (2006.01) |
| ***H01R 13/52*** | (2006.01) |
| ***H01R 4/18*** | (2006.01) |
| *H01R 13/42* | (2006.01) |

(52) U.S. Cl.

CPC ..... *H01R 13/5205* (2013.01); *H01R 4/185* (2013.01); *H01R 13/42* (2013.01)

(58) Field of Classification Search

CPC ..... H01R 13/4223; H01R 13/4365; H01R 13/4364; H01R 13/4362; H01R 13/422; H01R 13/5208; H01R 13/5205; H01R 13/5221; H01R 13/521; H01R 13/5219

USPC ..... 439/595, 587

See application file for complete search history.

(56) References Cited

U.S. PATENT DOCUMENTS

| | | | | |
|---|---|---|---|---|
| 5,607,318 | A * | 3/1997 | Wakata | H01R 13/4223 439/274 |
| 5,618,190 | A * | 4/1997 | Masuda | H01R 13/6582 439/680 |
| 6,123,574 | A * | 9/2000 | Matsuda | H01R 13/4223 439/488 |
| 6,146,215 | A * | 11/2000 | Matsushita | H01R 13/113 439/752 |
| 6,361,378 | B1 * | 3/2002 | Konoya | H01R 13/4364 439/595 |
| 6,386,916 | B1 * | 5/2002 | Tachi | H01R 13/4364 439/595 |
| 6,464,535 | B2 * | 10/2002 | Murakami | H01R 13/521 439/589 |
| 6,575,788 | B2 * | 6/2003 | Nimura | H01R 13/4223 439/595 |
| 6,592,398 | B2 * | 7/2003 | Kashiyama | H01R 13/641 439/188 |
| 6,626,702 | B2 * | 9/2003 | Kurimoto | H01R 13/4364 439/595 |

(Continued)

*Primary Examiner* — Abdullah Riyami
*Assistant Examiner* — Vladimir Imas
(74) *Attorney, Agent, or Firm* — Gerald E. Hespos; Michael J. Porco; Matthew T. Hespos

(57) ABSTRACT

A connector includes a housing (40) with a terminal accommodating chamber (50) and a terminal fitting (10) connected to an end of a wire (W) is inserted therein from behind. A sleeve (20) surrounds a part (15) of the terminal fitting (10) connected to the wire (W) and includes a locking portion (23) for the terminal fitting (10). A holder (60) is mounted on a rear of the housing (40) to retain the sleeve (20) by contacting a contact portion (36) on a rear end of the sleeve (20). The wire (W) is inserted through a rubber plug (70) that close contacts an inner peripheral surface of the terminal accommodating chamber (50). The rubber plug (70) is formed separately from the sleeve (20) and mounted on the sleeve (20) so that the contact portion (36) is exposed for contact by the holder (60).

4 Claims, 18 Drawing Sheets

(56) References Cited

U.S. PATENT DOCUMENTS 6,638,109 B2 * 10/2003 Kurimoto ..... H01R 13/4362 439/595
6,659,789 B2 * 12/2003 Nagamine ..... H01R 13/639 439/352
6,746,258 B2 * 6/2004 Kikuchi ..... H01R 13/635 217/1
6,783,381 B2 * 8/2004 Fukuda ..... H01R 13/5219 439/271
6,786,768 B2 * 9/2004 Murakami ..... H01R 13/4365 439/271
6,890,194 B2 * 5/2005 Katsuma ..... H01R 13/62905 439/157
7,168,981 B2 * 1/2007 Takahashi ..... H01R 13/4223 439/595
7,214,080 B2 * 5/2007 Ichio ..... H01R 13/6315 439/246
7,883,365 B2 * 2/2011 Saitou ..... H01R 13/5205 439/587
7,959,468 B2 * 6/2011 Yong ..... H01R 13/648 439/607.41
8,337,244 B2 * 12/2012 Sawamura ..... H01R 13/5208 439/271
8,662,921 B2 * 3/2014 Kataoka ..... H01R 13/443 439/148
9,048,563 B2 * 6/2015 Miura ..... H01R 12/81
9,099,804 B2 * 8/2015 Suzuki ..... H01R 13/4361
9,306,316 B2 * 4/2016 Aizawa ..... H01R 13/6598
2011/0059659 A1 3/2011 Matsumoto et al.
2015/0380863 A1 * 12/2015 Uchida ..... H01R 4/185 439/587
2016/0064851 A1 * 3/2016 Kataoka ..... H01R 13/5202 439/587

* cited by examiner

WATERPROOF CONNECTOR WITH SLEEVE

BACKGROUND

1. Field of the Invention

This specification relates to a connector with an individual waterproof function.

2. Description of the Related Art

U.S. Patent Application Publication No. 2011/0059659 discloses a charging connector with an individual waterproof function. This connector has a housing with a terminal accommodating chamber. A terminal fitting and a rear packing are mounted on an end of a wire and are inserted into the terminal accommodating chamber. An electrical contact portion is formed at a front end of the terminal fitting and is configured to be connected to a mating terminal. A flange is behind the electrical contact portion and a wire connecting portion at a rear end is configured to be crimped to the end of the wire. A sleeve surrounds the wire connecting portion.

The terminal fitting, the sleeve and the rear packing are inserted into the terminal accommodating chamber from behind and are stopped when the flange contacts a stepped surface at an intermediate position of the terminal accommodating chamber. The rear packing is fit tightly into a rear part of the terminal accommodating chamber with the sleeve sandwiched between the flange and the rear packing. A rear holder then is mounted on the rear surface of the housing. The rear packing makes each terminal accommodating chamber watertight. A rearward movement of the terminal fitting will cause the flange to push the sleeve against the rear packing held by the rear holder. Thus, movement of the terminal fitting is restricted, and the terminal fitting is retained.

The rear packing of Japanese Patent No. 5044508 engages the sleeve for retaining the terminal fitting and therefore must have rigidity in a thickness direction. Thus, the rear packing is manufactured by insert molding using a core made of a synthetic resin as an insert, and an improvement has been desired due to the complexity and cost of insert molding.

A technology disclosed herein was completed based on the above situation and aims to provide an inexpensive connector with an individual waterproof function.

SUMMARY OF THE INVENTION

This specification relates to a connector with a housing that includes a terminal accommodating chamber and a terminal fitting connected to an end of a wire. The terminal fitting is configured to be inserted into the terminal accommodating chamber from behind. A sleeve surrounds a part of the terminal fitting connected to the wire and includes a locking portion for the terminal fitting. A holder is mounted on a rear surface of the housing and contacts a contact portion on a rear end of the sleeve to retain the sleeve. The wire is inserted tightly through a rubber plug that is held in close contact with an inner peripheral surface of a rear end part of the terminal accommodating chamber. The rubber plug is formed separately from the sleeve and mounted on the sleeve in a state where the contact portion is exposed to contact the holder.

The rubber plug is mounted on the sleeve with the contact portion exposed. The rubber plug mounted on the sleeve is fit tightly into the rear end part of the terminal accommodating chamber when the terminal fitting is inserted into the terminal accommodating chamber of the housing. The sleeve then is retained by the holder mounted on the rear of the housing.

A backward pulling force on the wire will cause the terminal fitting to contact the locking portion of the sleeve retained by the holder. As a result, the terminal fitting is retained in the corresponding terminal accommodating chamber. In addition, individual waterproofness is ensured more reliably by fitting the rubber plug on the rear end part of the retained sleeve into the rear part of the terminal accommodating chamber. Furthermore, the rubber plug is formed separately from the sleeve so that individual waterproofness is achieved relatively inexpensively.

The sleeve may have circumferentially spaced projections that project from a rear end surface of a substantially tubular main body, and the rubber plug may be formed with mounting holes through which the projections tightly pass. Projecting end surfaces of the projections may function as the contact portions.

The rubber plug may be mounted to the rear end part of the sleeve and in contact with the rear end surface of the main body portion while the projections are press-fit into the mounting holes. The holder then contacts projecting end surfaces of the projections to retain the sleeve.

Locking heads are formed on projecting ends of the projections and function as the contact portions to be locked to rear hole edge parts of the mounting holes. The locking head portions lock the rubber plug more firmly on the sleeve.

The terminal fitting has a wire crimping portion to be crimped to the end of the wire is arranged behind a tubular terminal connecting portion to be connected to a mating terminal. The locking portion may be formed on a front end of the sleeve and may be configured to fit into a rear end of the terminal connecting portion. The sleeve is mounted to surround the wire crimping portion while the locking portion is fit into the terminal connecting portion.

The sleeve is assembled with the terminal fitting to define a sub-assembly by fitting the locking portion into the rear end part of the terminal connecting portion with friction between the rubber plug mounted on the sleeve and the wire passed through this rubber plug. Thus, inserting the terminal fitting and the sleeve into the terminal accommodating chamber can be performed efficiently.

DETAILED DESCRIPTION OF THE PREFERRED EMBODIMENTS

A first embodiment is described with reference to FIGS. 1 to 18. A charging connector is illustrated in this embodiment, and connected to a vehicle-side connector provided in a vehicle by being mounted into the tip of a gun-shaped case (not shown).

Figure 18:
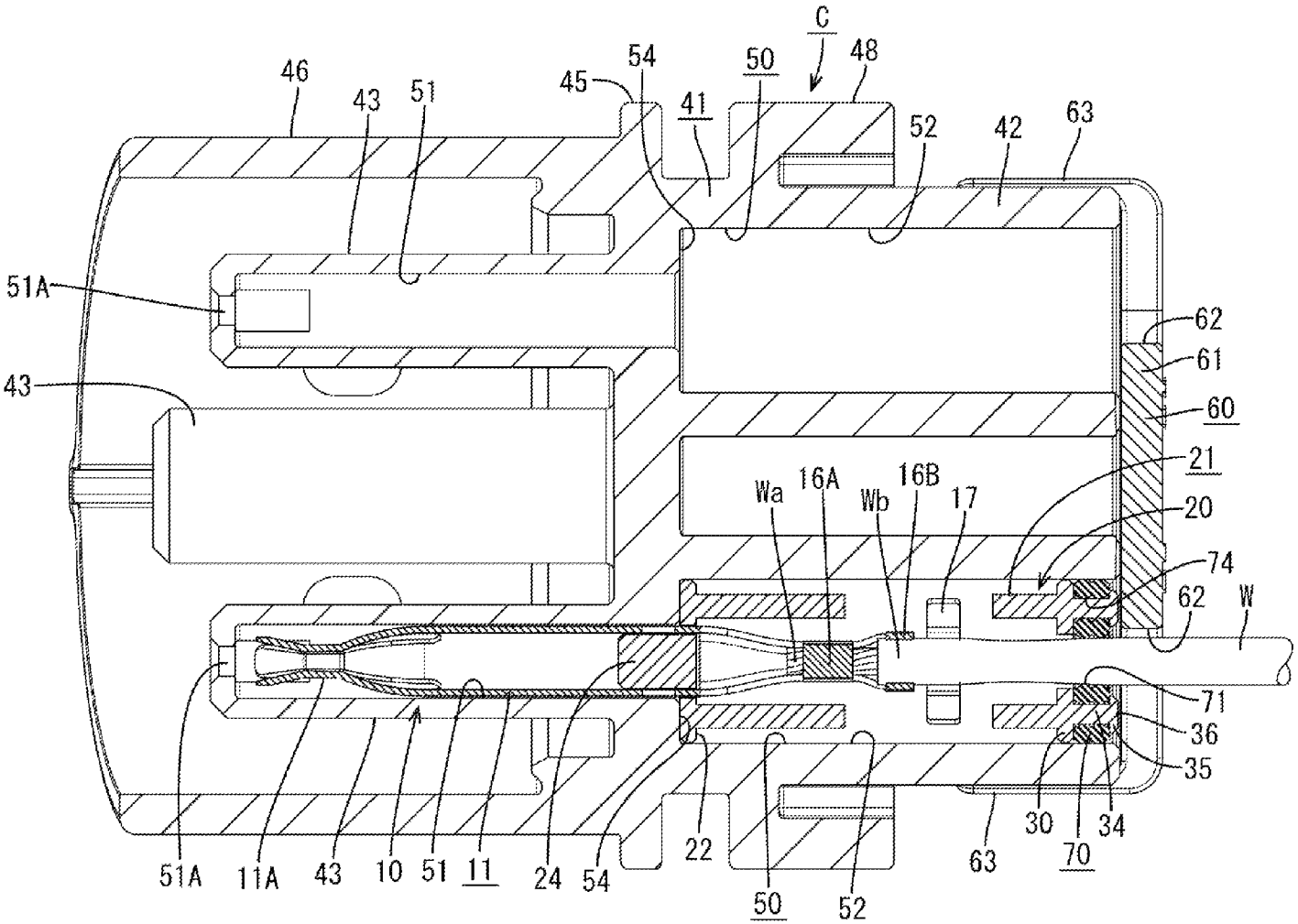
FIG. 18 is a section along XVIII-XVIII of FIG. 17.

The charging connector C of this embodiment is a five-pole connector and includes, as shown in FIG. 18, terminal fittings 10 connected to ends of wires W and a housing 40 for accommodating the terminal fittings 10.

The terminal fittings 10 include two power terminals, one ground terminal and two signal terminals and have a similar basic structure although a diameter and the like may differ depending on the type. The following description is given, taking the signal terminal as an example.

Figure 1:
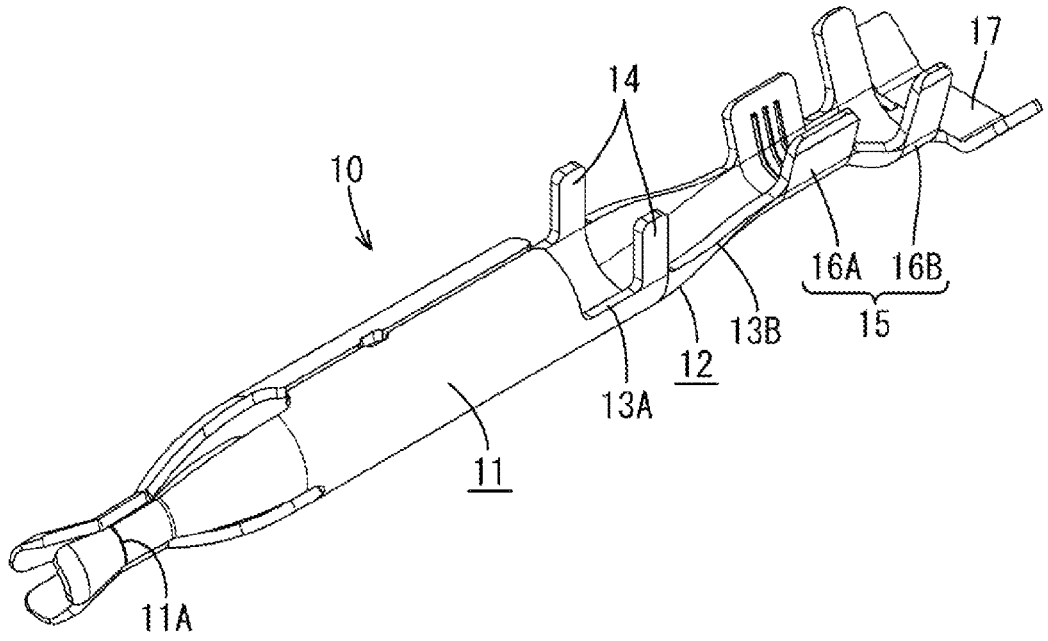
FIG. 1 is a perspective view of a terminal fitting according to a first embodiment.
Figure 2:
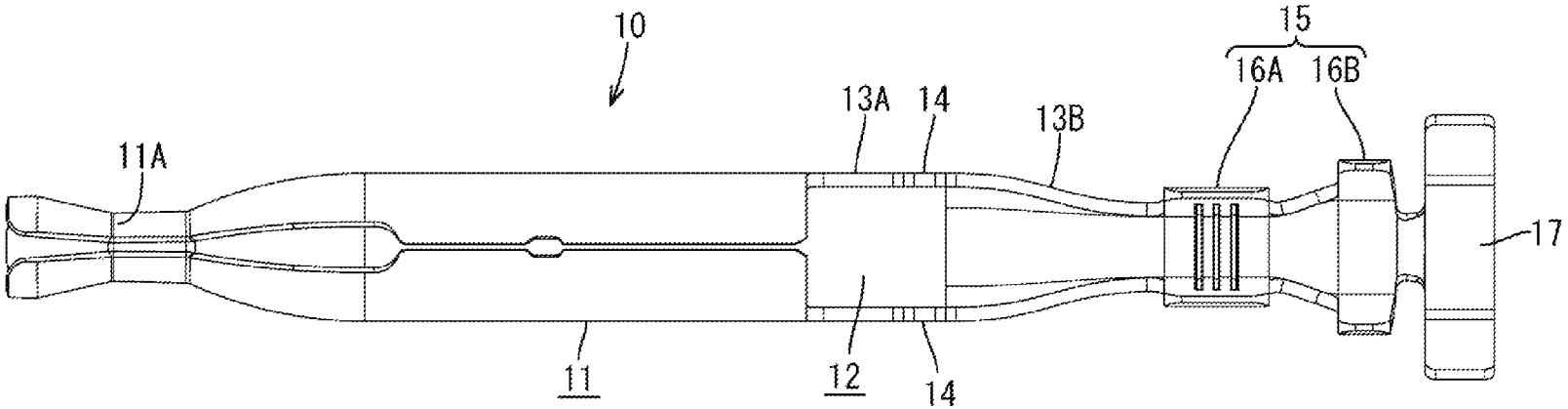
FIG. 2 is a plan view of the terminal fitting.
Figure 3:
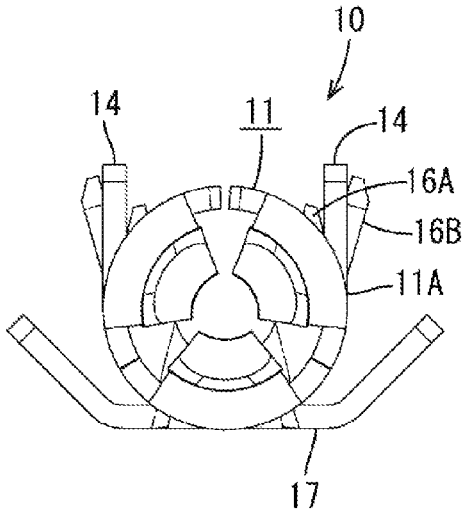
FIG. 3 is a front view of the terminal fitting.
Figure 4:
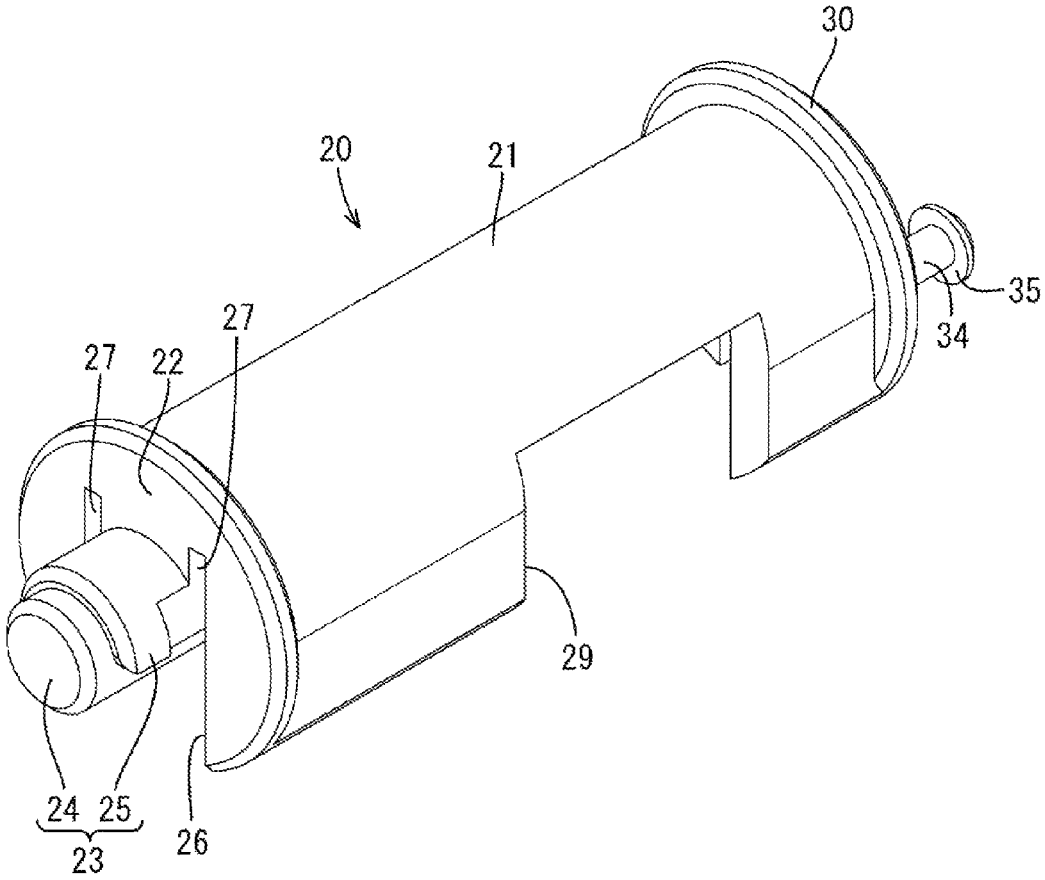
FIG. 4 is a perspective view of a sleeve.
Figure 5:
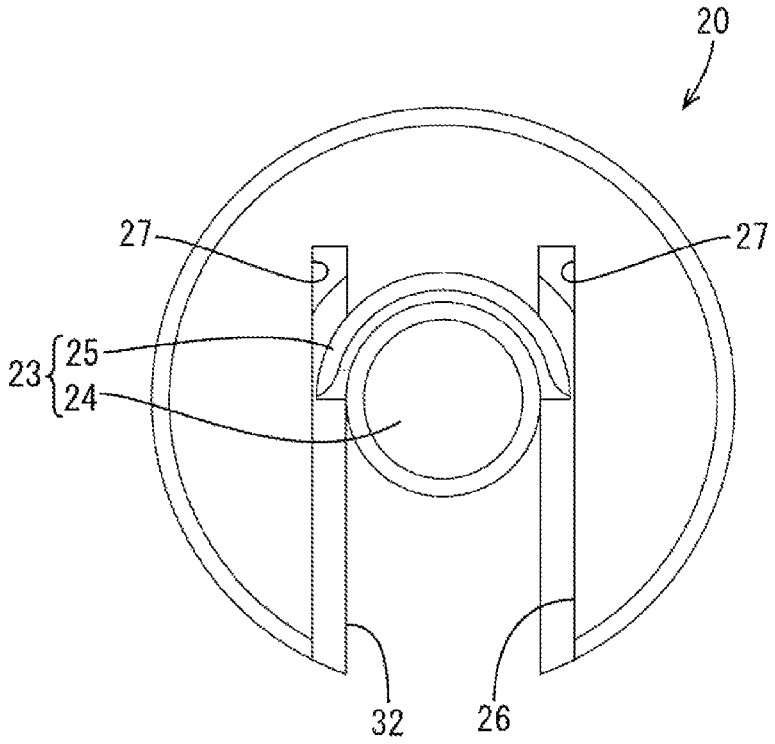
FIG. 5 is a front view of the sleeve.

The terminal fitting 10 is a female terminal that is formed into the shape shown in FIGS. 1 to 3 by press-molding a metal plate with excellent electrical conductivity. The terminal fitting 10 has a terminal connecting portion 11 to be connected to a mating vehicle-side terminal, a coupling 12, a wire crimping portion 15 to be crimped to the end of the wire W and a wire placing portion 17 arranged successively one after another from the front. The terminal connecting portion 11 has a hollow cylindrical shape with a tapered tip formed with slots to define a resiliently expandable and shrinkable contact portion 11A. The wire crimping portion 15 has an open wire barrel 16A and an open insulation barrel 16B arranged one after the other. The coupling 12 couples the terminal connecting portion 11 and the wire crimping portion 15 and has a U-shaped cross-section with an open upper end. A constant width portion 13A is at the front of the coupling 12 and has a length less than 40% of the entire length and a width equal to a diameter of the terminal connecting portion 11. A remaining rear area of the coupling 12 defines a tapered portion 13B that gradually narrows toward the rear. Two positioning pieces 14 stand up on rear end parts of left and right upper edges of the constant width portion 13A of the coupling 12. The wire placing portion 17 can receive the end of the wire W and holds the wire W in a predetermined posture during crimping.

Figure 17:
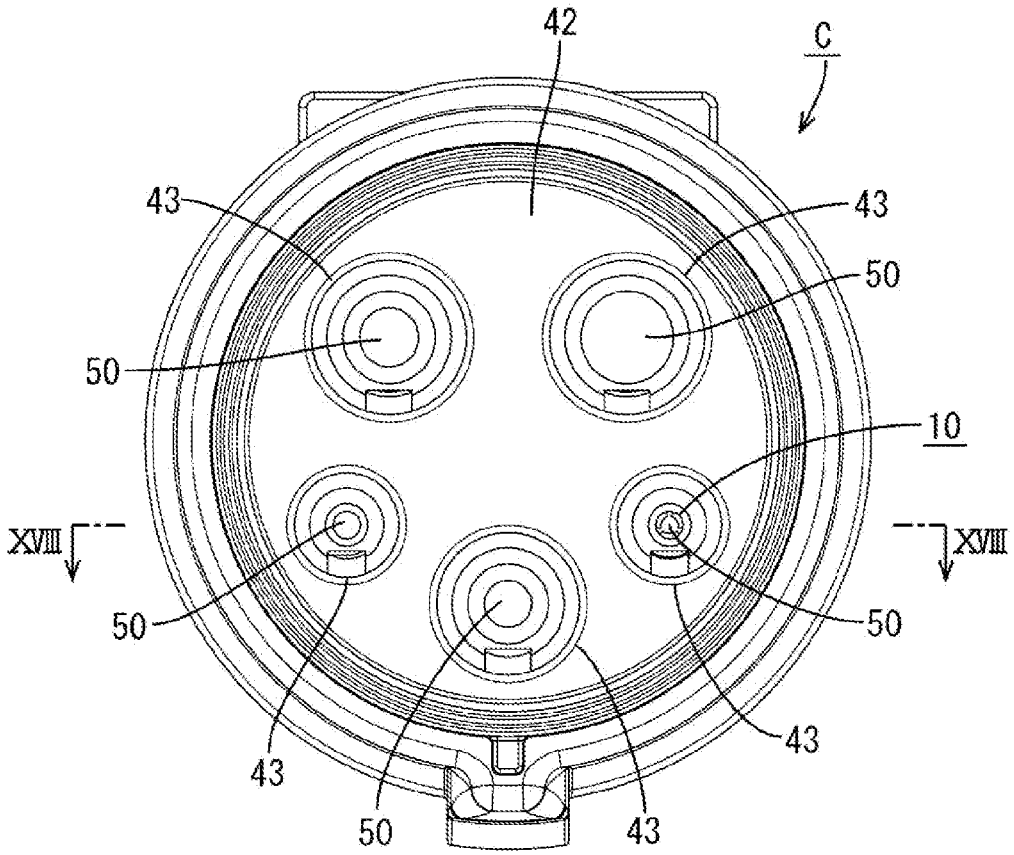
FIG. 17 is a front view of a connector.

The housing 40 is made of synthetic resin and, as shown in FIGS. 17 and 18, has a housing main body 41 with five tubular portions 43 projecting in a predetermined arrangement on the front surface of a short solid cylindrical base 42.

A flange 45 is formed on the outer periphery of the front end of the base 42 in the housing main body 41 and a forwardly open tubular receptacle 46 projects forward from the flange 45 while being spaced out from the outer peripheries of the tubular portions 43. As shown in FIG. 18, an opening edge of the receptacle 46 projects forward from the front ends of the tubular portions 43 and is inclined so that a lower part projects more forward than an upper part.

Although not shown, the receptacle 46 of the housing 40 is inserted tightly into an insertion port opening on a panel of the vehicle. The flange 45 contacts a front opening edge of the insertion port to stop insertion of the receptacle 46. Simultaneously, the receptacle 46 and the tubular portions 43 of the housing main body 41 are connected to the mating vehicle-side connector arranged in the insertion port.

The base 42 of the housing main body 41 is fit into the tip of the gun-shaped case. Thus, a mounting portion 48 is formed on the outer periphery of a front end part of the base 42 and can receive an opening on the tip of the gun-shaped case.

Five terminal accommodating chambers 50 extend into the housing main body 41 from the rear surface of the base 42 in the arrangement shown in FIG. 17 and extend in a front-back direction through the base 42 to the respective tubular portions 43. The two terminal accommodating chambers 50 in an upper row in FIG. 17 are for the power terminals, a slightly lower center terminal accommodating chamber 50 in a lower row is for the ground terminal and two left and right ones are for the signal terminals.

The terminal accommodating chambers 50 may differ in accordance with the types of the terminal fittings 10 to be accommodated, but have a similar basic structure. The following description is for the terminal accommodating chamber 50 for the signal terminal as an example.

As shown in FIG. 18, the terminal accommodating chamber 50 has a stepped shape with a front half located in the tubular portion 43 defining a small diameter narrow portion 51 and a rear half penetrating through the base 42 defining a large diameter wide portion 52. More specifically, the narrow portion 51 accommodates the terminal connecting portion 11 of the terminal fitting 10 and the wide portion 52 accommodates the wire crimping portion 15 of the terminal fitting 10. A step 54 is formed on a boundary between the narrow portion 51 at the front and the wide portion 52 at the rear.

A terminal insertion opening 51A is formed by narrowing the inner peripheral surface of a front end part of the narrow portion 51 and can receive the mating vehicle-side terminal.

A synthetic resin sleeve 20 is arranged around the wire crimping portion 15 of the terminal fitting 10 and is insertable into the wide portion 52. The sleeve 20 has a main body 21 is semi-cylindrical with a substantially C-shaped cross section and an open lower surface, as shown in FIGS. 4 to 7. Specifically, this main body 21 has side walls of a predetermined length hanging down from opposite left and right sides of the hollow semi-cylindrical portion.

A stopper plate 22 is formed on the front surface of the main body 21 to be brought into contact with the stepped surface 54 of the terminal accommodating chamber 50. The stopper plate 22 is circular with an outer diameter to fit tightly into the wide portion 52, and a lock 23 to be locked to the terminal fitting 10 projects in a center of the front surface of the stopper plate 22.

The lock 23 includes a round fitting bar 24 to be fit from a front end of the coupling 12 to a rear end part of the terminal connecting portion 11 in the terminal fitting 10 and a hollow semi-cylindrical abutting portion 25 covers the upper surface of the fitting bar 24 except a part having a predetermined dimension on a projecting end.

An escaping groove 26 having the same width as the abutting portion 25 is formed on the stopper plate 22 below the lock 23 and opens on a lower edge. Further, positioning grooves 27 are formed at opposite left and right sides of the lock 23 and receive the left and right positioning pieces 14 of the coupling 12 of the terminal fitting 10.

A rubber plug 70 formed separately from the sleeve 20 is mountable on a rear end part of the sleeve 20 by so-called retrofitting.

Figure 8:
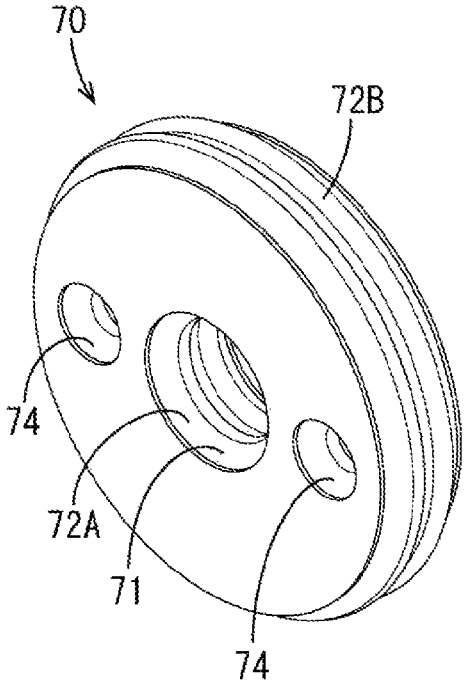
FIG. 8 is a perspective view of a rubber plug.
Figure 9:
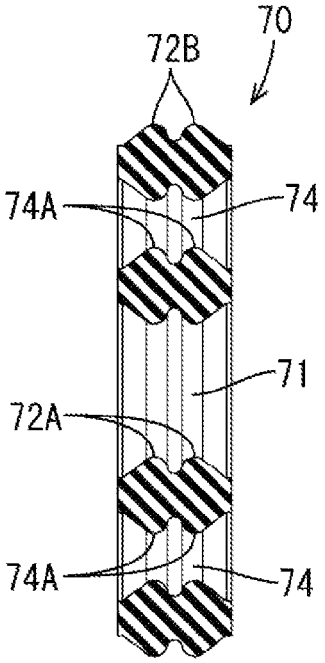
FIG. 9 is a section of the rubber plug
Figure 10:
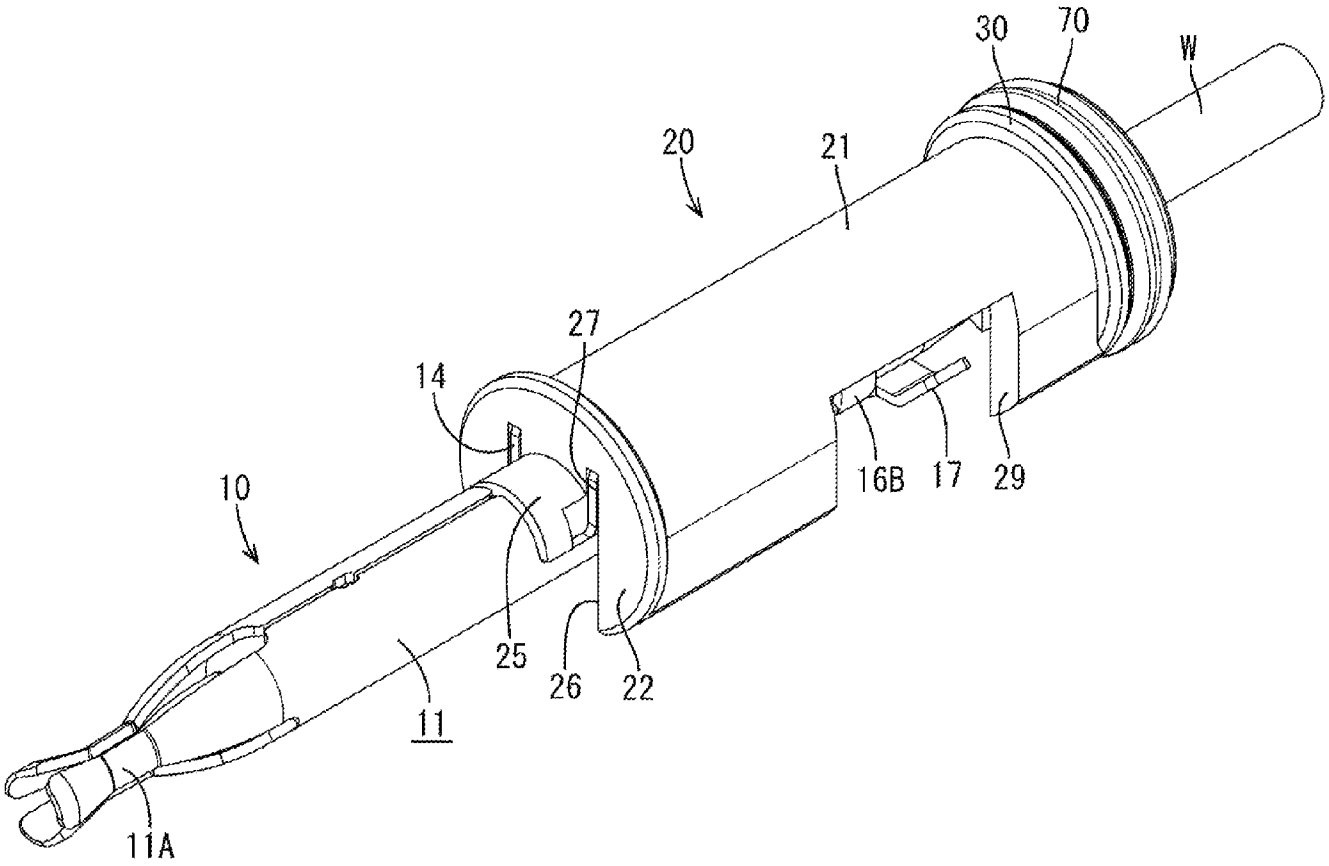
FIG. 10 is a perspective view showing the sleeve is assembled with the terminal fitting.
Figure 11:
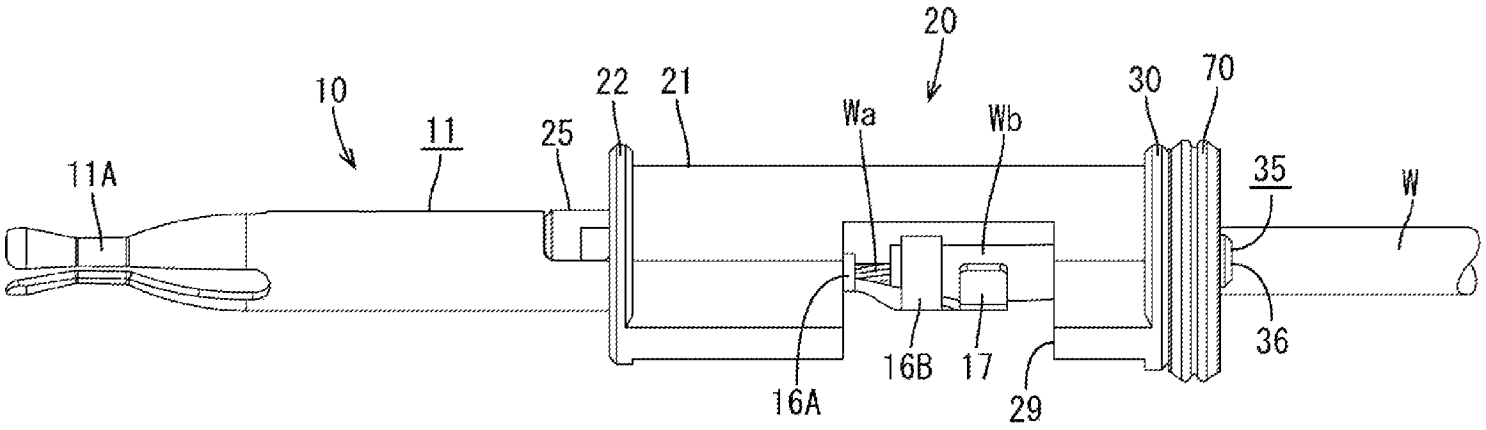
FIG. 11 is a side view showing the state of FIG. 10.
Figure 12:
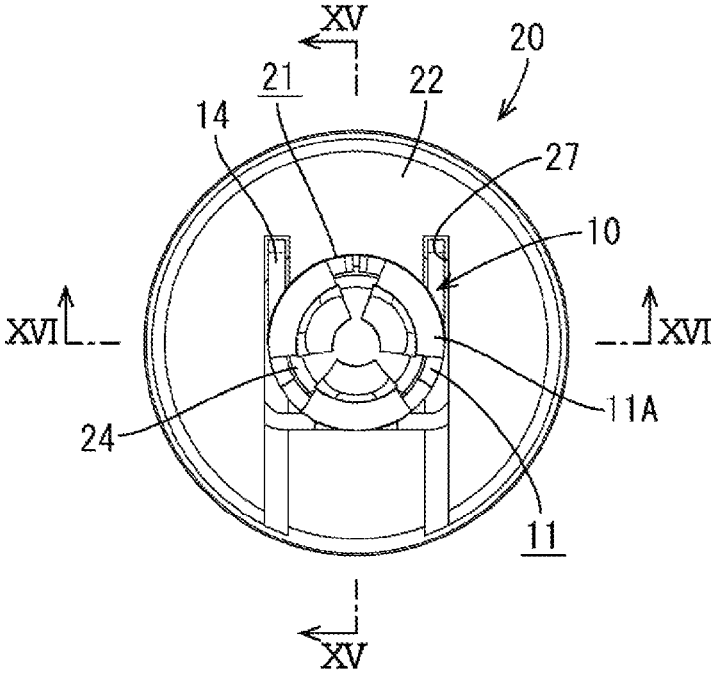
FIG. 12 is a front view showing the state of FIG. 10.
Figure 13:
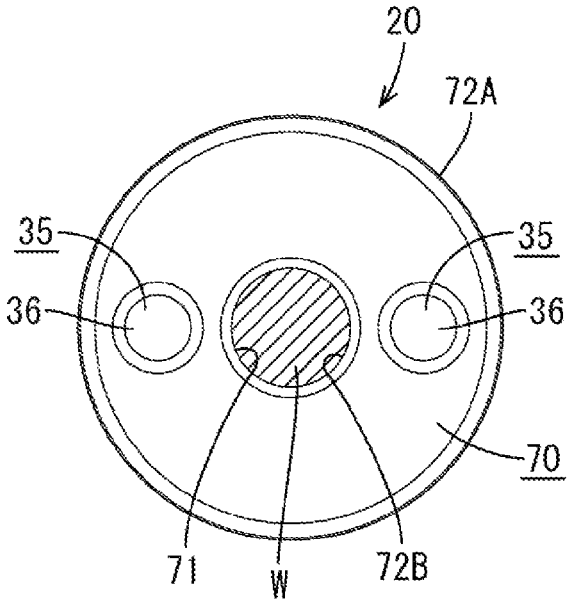
FIG. 13 is a rear view showing the state of FIG. 10.

As shown in FIGS. 8 and 9, the rubber plug 70 is a ring including a center hole 71 through which the wire W is inserted tightly. Lips 72A, 72B are formed respectively on the inner and outer peripheries. The outer peripheral surface of the rubber plug 70 can closely contact the inner peripheral surface of a rear part of the wide portion 52 of the terminal accommodating chamber 50.

Two mounting holes 74 penetrating through front and rear surfaces are formed at an angular interval of 180° in an annular region around the center hole 71 of the rubber plug 70. Lips 74A are formed on the inner peripheral surfaces of the mounting holes 74.

Figure 6:
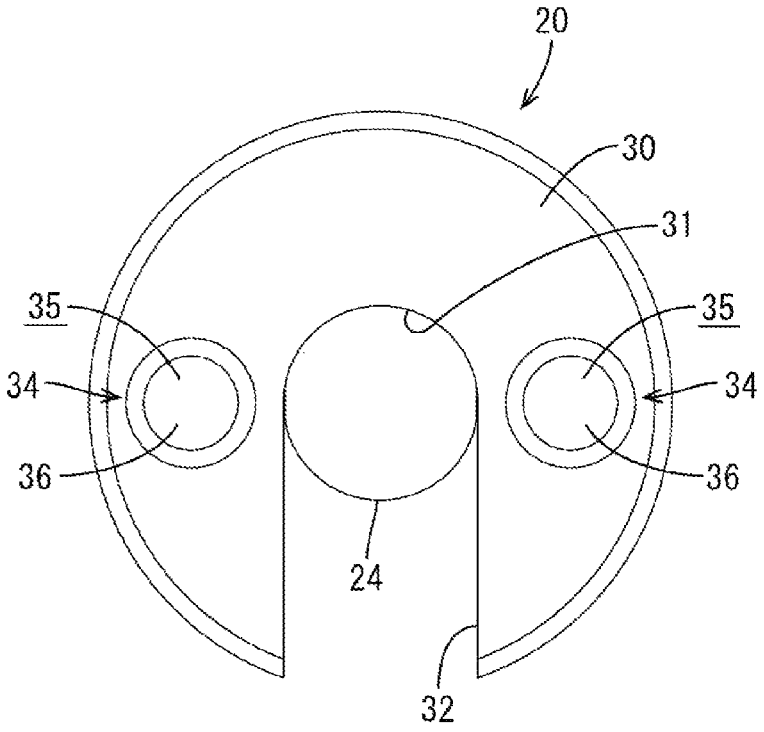
FIG. 6 is a rear view of the sleeve.

A circular mounting plate 30 for the rubber plug 70 is formed on the rear of the main body 21 of the sleeve 20 and has the same outer diameter as the stopper plate 22 on the front end. A wire insertion hole 31 is formed in a center of the mounting plate 30, as shown in FIG. 6, and the wire W is inserted therethrough. An insertion groove 32 having a width equal to a diameter of the wire insertion hole 31 extends from the wire insertion hole 31 to a lower edge.

Figure 7:
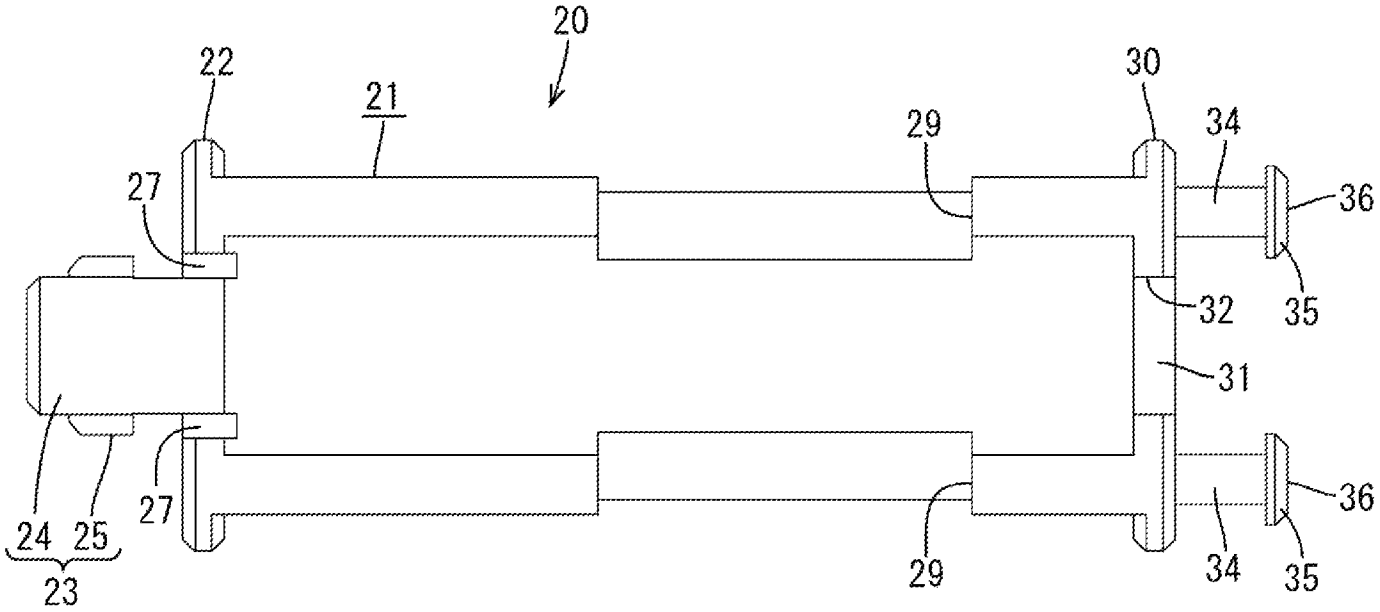
FIG. 7 is a bottom view of the sleeve.

As shown in FIG. 7, projections 34 in the form of round bars project on the rear surface of the mounting plate 30 at opposite left and right sides of the wire insertion hole 31 and are inserted tightly into the mounting holes 74 of the rubber plug 70. Each projection 34 has a length equal to a thickness of the rubber plug 70, and a locking head 35 is on a projecting end of the projection 34 and is to be locked to a rear edge of the mounting hole 74. A rear surface 36 of the locking head 35 is flat.

A length from the front surface of the stopper plate 22 to the rear end surfaces 36 of the locking heads 35 of the projections 34 in the sleeve 20 equals a length of the wide portion 52 of the terminal accommodating chamber 50, i.e. a length from the stepped surface 54 to the rear end opening surface of the wide portion 52.

A window 29 is open on a lower edge on each of left and right side surfaces of the main body 21 of the sleeve 20.

A rear holder 60 is mountable on the rear surface of the base 42 of the housing main body 41 and functions to retain the sleeve 20. The rear holder 60 is made of synthetic resin and has a substantially cap shape with a circular holder base plate 61 formed with insertion holes 62 for the wires W and lock pieces 63 that project forward from the peripheral edge of the base plate 61. The lock pieces 63 fit resiliently on lock protrusions (not shown) formed on the outer peripheral surface of the base 42 after the rear holder 60 is mounted on a rear end of the base 42 of the housing main body 41 and the holder base plate 61 contacts the rear surface of the base portion 42.

As described in detail later, the holder base plate 61 contacts the rear end surfaces 36 of the locking heads 35 of the projections 34 of each sleeve 20 to retain each sleeve 20. Thus, the rear end surface of the locking head 35 of the projection 34 defines a "contact portion."

Figure 15:
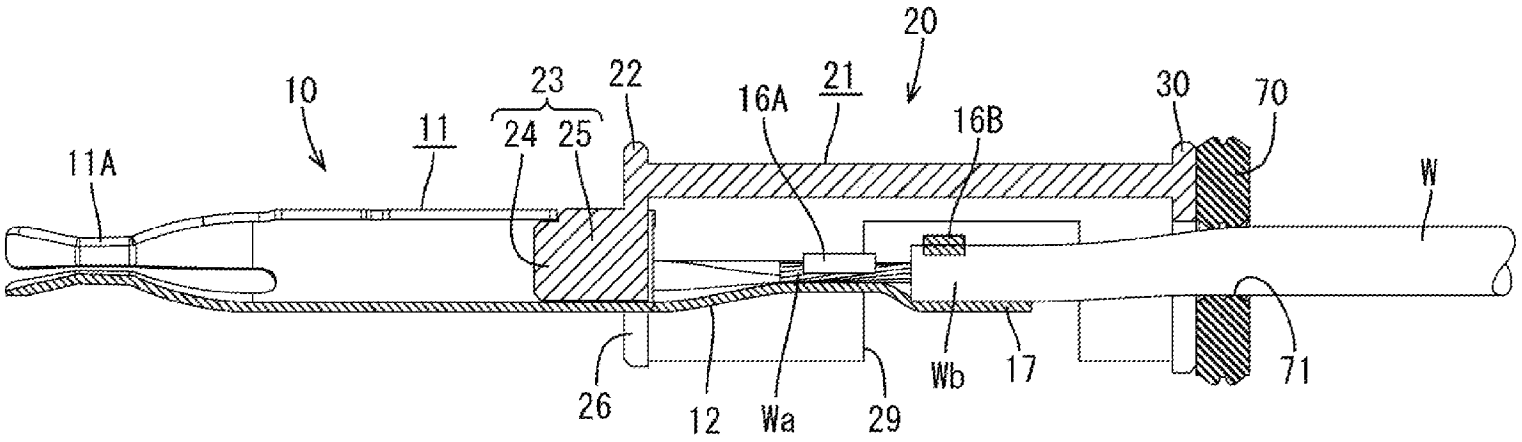
FIG. 15 is a section along XV-XV of FIG. 12.

The connector C is assembled by first mounting the rubber plug 70 on the wire W and applying an end processing, such as stripping, to the wire W. Then, the wire W is placed on the wire placing portion 17, and an exposed end of a core Wa and an end of an insulation coating Wb of the wire W are fixed respectively to the wire barrel 16A and the insulation barrel 16B by caulking, as shown in FIG. 15.

The sleeve 20 is mounted around the wire crimping portion 15 in the terminal fitting 10 connected to the end of the wire W as described above. Specifically, the fitting bar 24 of the locking portion 23 is placed and fitted on the coupling 12 of the terminal fitting 10 while the posture of the sleeve 20 is determined by fitting the positioning pieces 14 into the positioning grooves 27 formed on the stopper plate 22. The sleeve 20 then is pushed forward to fit the tip of the fitting bar 24 into the rear end of the terminal connecting portion 11. The pushing of the sleeve 20 is stopped when the abutting portion 25 contacts an upper half of the rear end edge of the terminal connecting portion 11.

Figure 14:
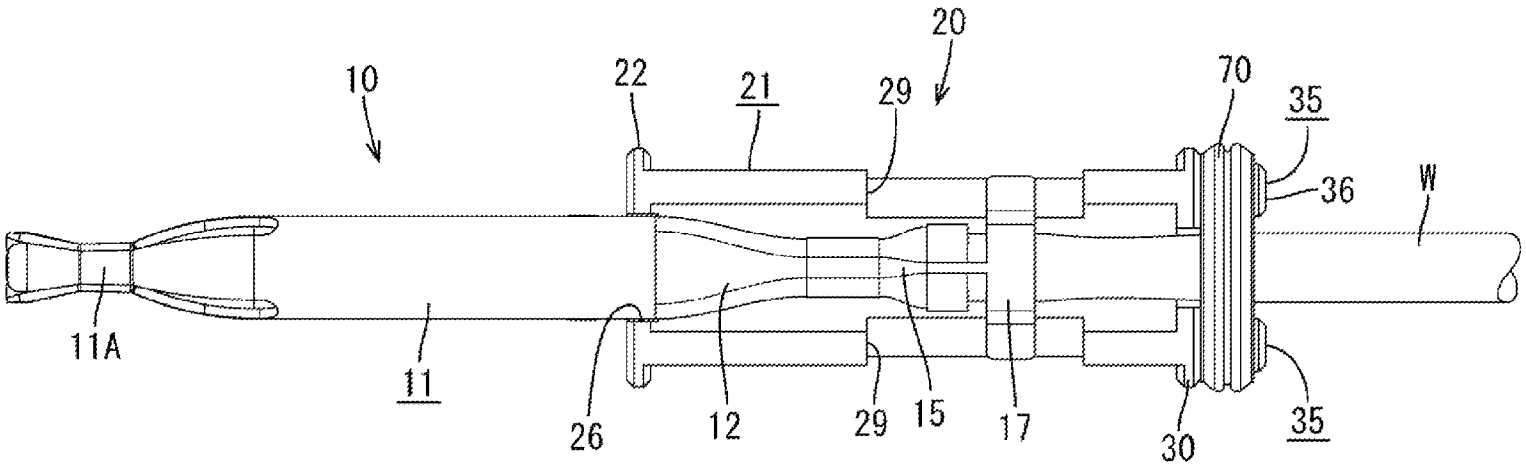
FIG. 14 is a bottom view showing the state of FIG. 10.

As shown in FIG. 14, the opposite ends of the wire placing portion 17 are fit into the window holes 29 formed on the side surfaces of the sleeve 20 to escape.

In addition, the wire W drawn out backward of the terminal fitting 10 is inserted radially into the insertion groove 32 of the mounting plate 30 of the sleeve 20 and fit into the wire insertion hole 31 in the center. Subsequently, the rubber plug 70, mounted beforehand, is moved forward along the wire W and the mounting holes 74 formed in the rubber plug 70 are pushed to the projections 34 with the locking heads 35 projecting on the mounting plate 30.

Figure 16:
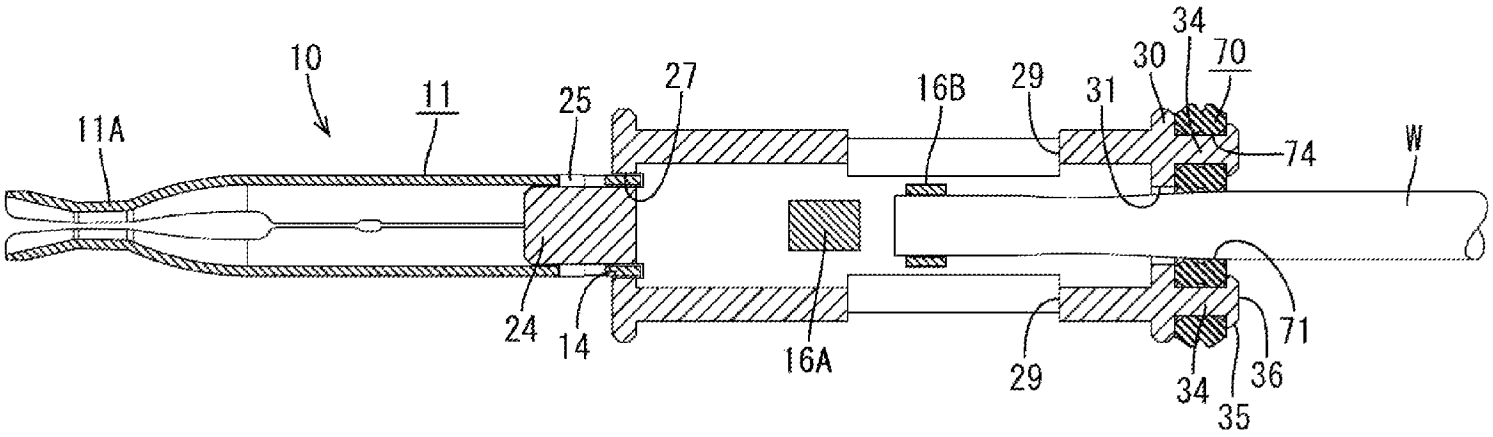
FIG. 16 is a section along XVI-XVI of FIG. 12.

The rubber plug 70 is pushed while the mounting holes 74 resiliently enlarge and deform, and the locking heads 35 come out backward from the mounting holes 74 when the front surface of the rubber plug 70 contacts the mounting plate 30. The locking heads 35 are locked to the rear edges of the mounting holes 74, as shown in FIGS. 14 and 16. Thus, the rubber plug 70 is mounted on the rear end part of the sleeve 20 and cannot be detached.

The tip of the fitting bar 24 constituting the lock 23 on the front end of the sleeve 20 is fit into the rear end part of the terminal connecting portion 11 and friction is applied between the center hole 71 of the rubber plug 70 mounted on the sleeve 20 and the wire W passed through the center hole 71, thereby forming a sub-assembly in which the sleeve 20 is mounted on the terminal fitting 10 connected to the end of the wire W.

The terminal fitting 10 sub-assembled with the sleeve 20 as described above is inserted from behind into the corresponding terminal accommodating chamber 50 in the housing main body 41. As shown in FIG. 18, the insertion of the terminal fitting 10 is stopped when the stopper plate 22 on the front of the sleeve 20 contacts the step 54 in the terminal accommodating chamber 50 and the rubber plug 70 mounted on the rear end part of the sleeve 20 is fit tightly into the wide portion 52.

After the terminal fittings 10 and the sleeves 20 are inserted into all the terminal accommodating chambers 50, the rear holder 60 is arranged behind the base 42 while the wires W drawn out from the rear end surface of the base portion 42 of the housing main body 41 are inserted through the insertion holes 62. When the rear holder 60 moves forward along the wires W and mounted to the rear end surface of the base 42 to be locked, the holder base plate 61 contacts the rear end surfaces 36 of the locking heads 35 of the projections 34 projecting on the mounting plates 30 of the sleeves 20 to retain the sleeves 20.

In this way, when a backward pulling force is applied to the wire W, the rear end edge of the terminal connecting portion 11 of the terminal fitting 10 comes into contact with the lock 23 (abutting portion 25) of the sleeve 20 retained by the rear holder 60 to be stopped. As a result, each terminal fitting 10 is retained in the corresponding terminal accommodating chamber 50.

The assembled connector C is mounted into the tip part of the gun-shaped case, and the wires W drawn out backward of the connector C are drawn out from the rear end of the gun-shaped case and connected to an external power supply after being bundled.

During a charging operation, the connector C in the tip of the gun-shaped case is connected to the mating vehicle-side connector through the insertion port open on the panel of the vehicle.

Water may try to enter the connector C from the rear surface side of the housing 40 after entering the gun-shaped case, is prevented However, the rubber plugs 70 mounted in the rear end parts of the wide portions 52 of the corresponding terminal accommodating chamber 50 prevents the entrance of water into the wide portions 52.

As described above, if a backward moving force is applied to the terminal fitting 10, the terminal fitting 10 contacts the lock 23 (abutting portion 25) of the sleeve 20 retained by the rear holder 60 and is stopped. Thus, the terminal fitting 10 is retained and accommodated in the corresponding terminal accommodating chamber 50. In addition, the rubber plug 70 mounted on the rear end of this retained sleeve 20 is fit tightly into the wide portion 52 of the corresponding terminal accommodating chamber 50, thereby ensuring waterproofness.

The rubber plug 70 is formed separately from the sleeve 20 and mounted by so-called retrofitting. Thus, individual waterproofness can be achieved inexpensively.

The sleeve 20 is positioned and temporarily held with the terminal fitting 10 as a sub-assembly by friction between the center hole 71 of the rubber plug 70 mounted on the sleeve 20 and the wire W by fitting the tip of the fitting bar 24 of the lock 23 into the rear part of the terminal connecting portion 11. Thus, inserting the terminal fitting 10 together with the sleeve 20 into the terminal accommodating chamber 50 can be performed efficiently.

The projections 34 to be press-fit into the mounting holes 74 of the rubber plug 70 have the locking heads 35 in a part where the rubber plug 70 is mounted in contact with the mounting plate 30 of the sleeve 20. Thus, the rubber plug 70 is difficult to detach and the operation of inserting the sub-assembly into the terminal accommodating chamber 50 is performed more easily.

A second embodiment is described with reference to FIGS. 19 to 23. In the second embodiment, a structure of a part where a rubber plug 70X is mounted on the rear end of a sleeve 20X is changed as compared with the first embodiment. Points of difference from the first embodiment are mainly described below, and parts and members with the same functions as the first embodiment are not described or briefly described by being denoted by the same reference signs.

Figure 19:
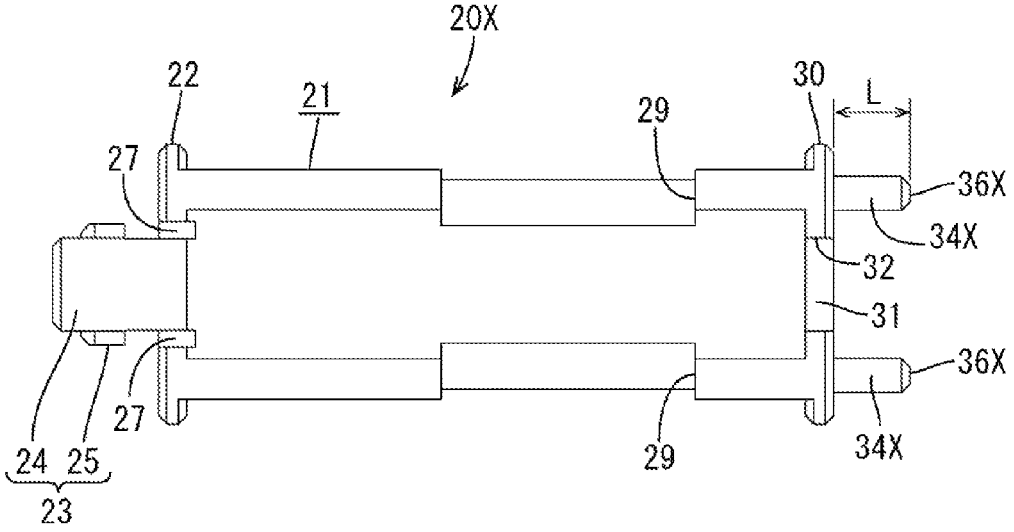
FIG. 19 is a bottom view of a sleeve according to a second embodiment.
Figure 20:
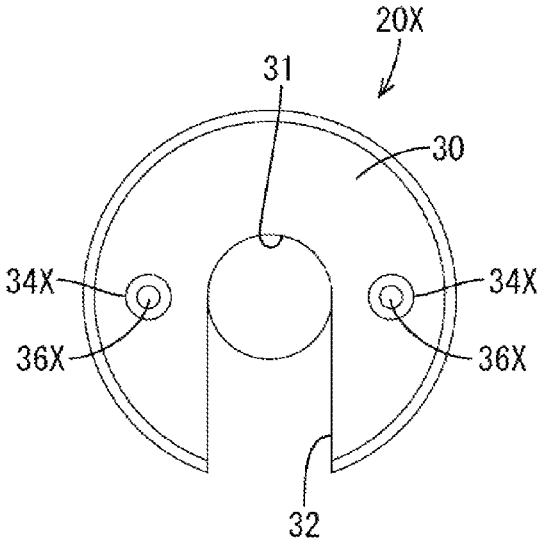
FIG. 20 is a rear view of the sleeve.

As shown in FIGS. 19 and 20, two projections 34X project on the rear surface of a mounting plate 30 in the sleeve 20X are in the form of straight round bars with no locking head. A length L of the projection 34X is equal to that of the projection 34 including the locking head portion 35 in the first embodiment. A rear end surface 36X of the projection 34X serves as a "contact portion" to be brought into contact with a holder base plate 61 of a rear holder 60.

Figure 21:
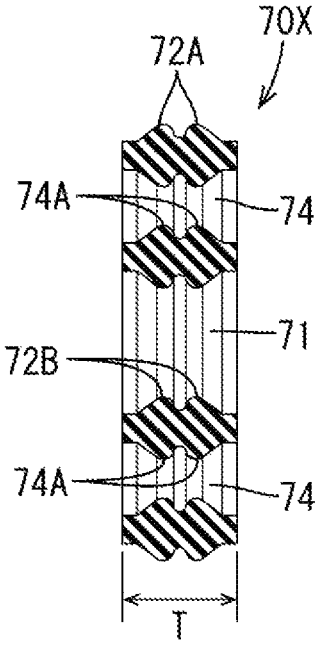
FIG. 21 is a section of a rubber plug.
Figure 22:
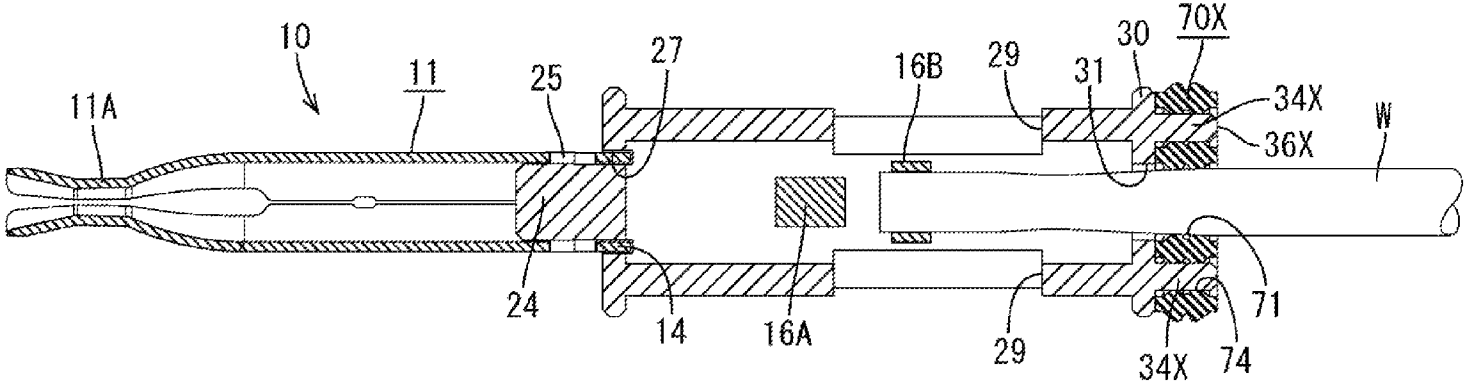
FIG. 22 is a plan view in section showing the sleeve is assembled with a terminal fitting.

As shown in FIG. 21, the rubber plug 70X has the same basic structure as the rubber plug 70 of the first embodiment, but is thicker than the rubber plug 70. Specifically, the rubber plug 70X has a thickness T equal to the length L (see FIG. 19) of the projection 34X. Thus, when the rubber plug 70X is pushed while the projections 34X are inserted into mounting holes 74 and contacts the mounting plate 30 to be stopped as shown in FIG. 22, the rear ends 36X (contact portions) of the projections 34X become flush with rear end openings of the mounting holes 74.

The other structure including the sub-assembling of the sleeve 20X with a terminal fitting 10 is similar to the first embodiment.

Figure 23:
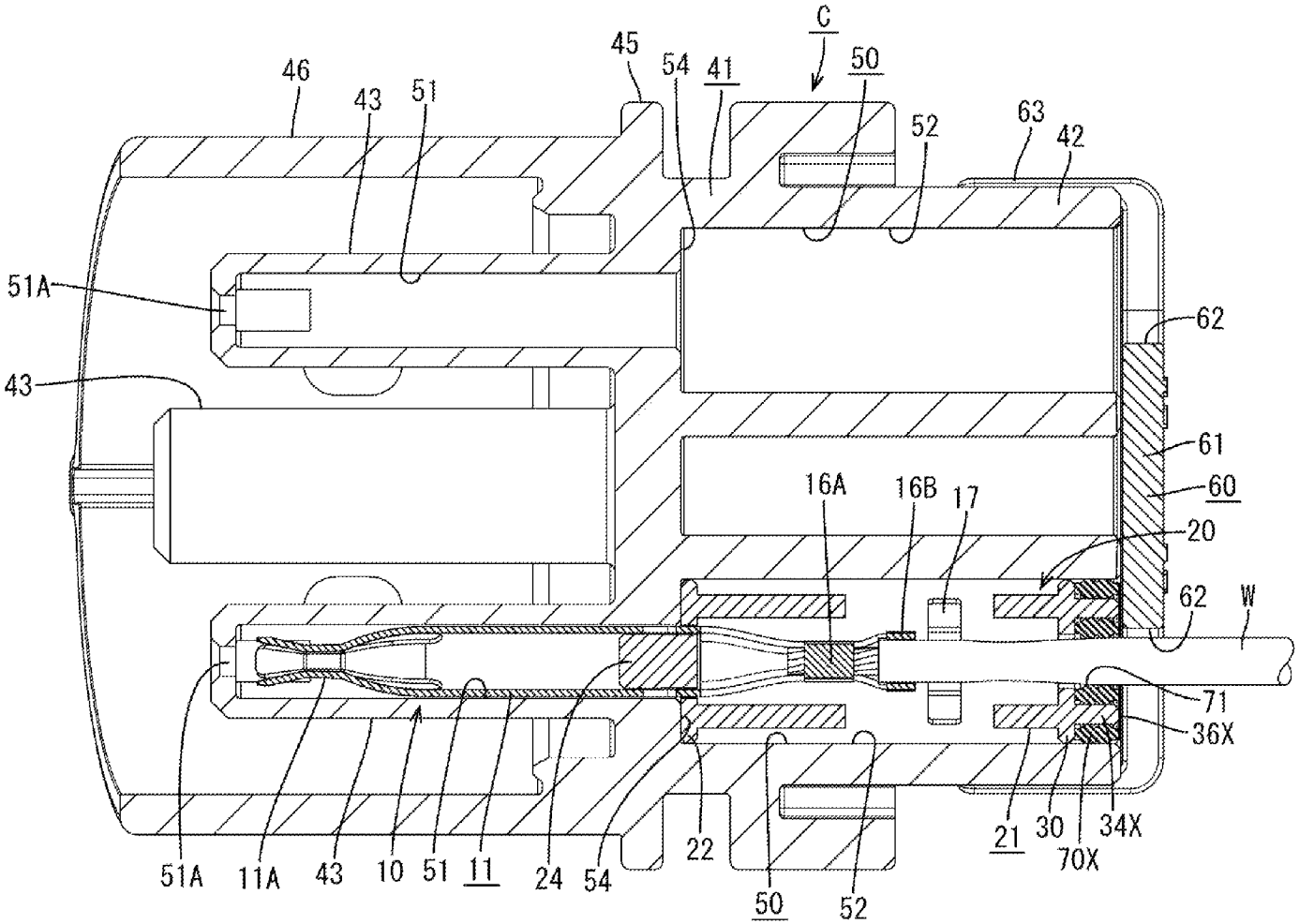
FIG. 23 is a section of a connector.

When the rear holder 60 is mounted on the rear end surface of a base plate 42 of a housing main body 41 to be locked after predetermined terminal fittings 10 and the sleeves 20X are inserted into all the terminal accommodating chambers 50 as shown in FIG. 23, the holder base plate 61 contacts the rear end surfaces 36X of the projections 34X projecting on the mounting plates 30 of the sleeves 20X and the sleeves 20X are retained.

In this way, when a backward pulling force is applied to the wire W, the rear end of a terminal connecting portion 11 of the terminal fitting 10 contacts a locking portion 23 (abutting portion 25) of the sleeve 20 retained by the rear holder 60 to be stopped. Thus, each terminal fitting 10 is retained and accommodated in the corresponding terminal accommodating chamber 50.

In addition, the rubber plug 70X mounted on the rear end part of this retained sleeve 20X is fit tightly into a rear end part of a wide portion 52, thereby ensuring waterproofness for the crimping portion accommodating portion 52.

The projections 34X on which the rubber plug 70X is mounted are simply in the form of round bars in the second embodiment, the shape of the entire sleeve 20 can be simplified, a molding die can be simplified, and a mounting operation of the rubber plug 70X can also be simplified, thereby reducing manufacturing cost.

The projections 34X are made longer by removing the locking heads, the rubber plug 70X can be thicker by that much and a sealing function can be enhanced.

The invention is not limited to the above described and illustrated embodiments. For example, the following embodiments are also included.

The number of the projections formed to project on the rear end surface of the sleeve to mount the rubber plug is not limited to two, and may be three or more.

The shape of the projections is also not limited to the round bar shape illustrated in the above embodiment and may be another shape such as an arcuate wall shape.

Although the sleeve is assembled with the terminal fitting to form the sub-assembly in the above embodiments, the sleeve and the terminal fitting may be individually inserted into the terminal accommodating chamber without being sub-assembled.

Although the terminal fitting of an open barrel structure formed by press-molding the metal plate is illustrated in the above embodiments, a terminal fitting of a closed barrel structure formed by cutting a metal bar may be adopted.

Although the charging connector is illustrated in the above embodiments, there is no limitation to this and wide application to connectors in general having the individual waterproof function is possible.

LIST OF REFERENCE SIGNS

C . . . charging connector (connector)
W . . . wire
10 . . . terminal fitting
11 . . . terminal connecting portion
15 . . . wire crimping portion
20, 20X . . . sleeve
21 . . . main body
23 . . . locking portion
24 . . . fitting bar
25 . . . abutting portion
30 . . . mounting plate
34, 34X . . . projection
35 . . . locking head portion
36 . . . rear end surface (contact portion) (of locking head portion 35)
40 . . . housing
41 . . . housing main body

50 . . . terminal accommodating chamber
52 . . . wide portion
60 . . . rear holder (holder)
61 . . . holder base plate
70, 70X . . . rubber plug
71 . . . center hole
74 . . . mounting hole

What is claimed is:

1. A connector, comprising:

a terminal fitting extending in forward and backward directions and connected to an end of a wire, the terminal fitting having a terminal connection portion at a forward end thereof, a wire crimping portion at a rear end thereof, and a coupling between the terminal connecting portion and the wire crimping portion;

a housing with a terminal accommodating chamber into which the terminal fitting is inserted from behind;

a sleeve mounted on the terminal fitting and inserted into the terminal accommodating chamber with the terminal fitting, the sleeve having a main body with opposite front and rear ends spaced apart in the forward and backward direction and a lock projecting forward from the front end, the lock including a fitting bar to be fit between a front end of the coupling and a rear end part of the terminal connecting portion and an abutting portion projecting from the fitting bar in a direction transverse to the extending direction and configured contact the terminal connecting portion and retain the terminal fitting in the housing;

a holder mounted on a rear surface of the housing to retain the sleeve by coming into contact with a contact portion provided on the rear end of the sleeve; and a rubber plug through which the wire is inserted tightly and that is held in close contact with an inner peripheral surface of a rear end part of the terminal accommodating chamber, the rubber plug is formed separately from the sleeve and mounted on the sleeve in a state where the contact portion is exposed to be able to come into contact with the holder.

2. The connector of claim 1, wherein the sleeve is shaped such that a plurality of projections project at intervals in a circumferential direction from a rear end surface of a substantially tubular main body, the rubber plug is formed with mounting holes through which the projections are tightly passed, and projecting ends of the projections serve as the contact portions.

3. The connector of claim 2, wherein locking heads to be locked to rear hole edge parts of the mounting holes are formed on projecting ends of the projections and the locking head portions define the contact portions.

4. The connector of claim 1, wherein the locking is formed to be fittable into a rear end of the terminal connecting portion and the sleeve substantially surrounds the wire crimping portion while the lock is fit into the terminal connecting portion.

* * * * *